US005219220A

United States Patent [19]

Kucera et al.

[11] Patent Number: 5,219,220

[45] Date of Patent: Jun. 15, 1993

[54] FOUR-FILM DIAGONAL GUSSET SEALS FOR BAGS

[75] Inventors: Rod A. Kucera, Rochester; Norman R. Youngjohn, Macedon, both of N.Y.

[73] Assignee: Mobil Oil Corporation, Fairfax, Va.

[21] Appl. No.: 878,268

[22] Filed: May 4, 1992

[51] Int. Cl.[5] ..... B65D 30/20

[52] U.S. Cl. ..... 383/120; 383/121; 383/903

[58] Field of Search ..... 383/120, 121, 122, 903, 383/104

[56] References Cited

U.S. PATENT DOCUMENTS

| | | | |
|---|---|---|---|
| 3,143,277 | 8/1964 | La Fleur | 383/120 |
| 3,326,449 | 6/1967 | Dickson | 383/120 |
| 3,381,886 | 5/1968 | Goglio | 383/121 |
| 3,660,959 | 5/1972 | LaFleur . | |
| 3,857,329 | 12/1974 | Lehmacher et al. . | |
| 4,491,959 | 1/1985 | Loefberg | 383/104 |
| 4,554,192 | 11/1985 | Benoit . | |
| 4,783,178 | 11/1988 | Herder | 383/120 |
| 4,816,104 | 3/1989 | Benoit | 383/121 |
| 4,913,561 | 4/1990 | Beer | 383/120 |

FOREIGN PATENT DOCUMENTS

| | | | |
|---|---|---|---|
| 1010094 | 11/1965 | United Kingdom . | |
| 1275399 | 5/1972 | United Kingdom | 383/120 |

*Primary Examiner*—Stephen P. Garbe

*Attorney, Agent, or Firm*—Alexander J. McKillop; Charles J. Speciale; Malcolm D. Keen

[57] ABSTRACT

A gusseted thermoplastic bag has two four-film diagonal seals each extending from the gusset points to the edge of the bag. The diagonal seals extend at an angle of less than 45° with respect to the bottom seal. Diagonal seals with an angle between 25°–35° are shown to be superior.

1 Claim, 1 Drawing Sheet

FOUR-FILM DIAGONAL GUSSET SEALS FOR BAGS

FIELD OF THE INVENTION

This invention relates to thermoplastic bags having improved leakage characteristics.

BACKGROUND OF THE INVENTION

Bags made of plastic film such as thin polyethylene film have been used in various sizes. Small bags are used in the packaging of sandwiches and the like; larger bags are used as grocery bags and even larger bags are used for containing trash. The present invention is particularly related to the large bags which are used to carry trash and garbage and where leakage is a problem.

U.S. Pat. No. 4,554,192-Benoit discloses the use of angle seals at the bottom corners of a thermoplastic grocery bag to relieve stress at the gusset point. The gusset point is where the gusset fold intersects the bottom seal of the bag. The gusset point is subject to much stress when the bag is loaded. Small holes emerging at the gusset points are a persistent problem in gusseted thermoplastic bags. Holes are a particular problem in bags used to carry garbage because even the smallest hole will cause leakage.

Diagonal bottom seals have been successfully used in grocery bags to reduce stress and prevent tearing and failure of loaded bags. Diagonal seals have also been used to provide a square bottom for thermoplastic bags as is shown in U.S. Pat. No. 3,857,329-Lehmacher; U.S. Pat. No. 3,660,959- La Fleur and in the British Patent 1,010,094-Crawshaw. These diagonal seals extend through two layers of film material, the front or rear bag panel and one of the gusset panels.

The use of such two-film angle seals has reduced tearing of grocery bags, but it has not eliminated the development of small holes at the gusset points in loaded bags. Such holes are prevalent in angle-sealed grocery bags. The development of these small holes is not a serious problem in grocery bags. However, leakage in a garbage bag is a significant problem.

It is an object of the present invention to prevent development of holes at the gusset points of thermoplastic bags so as to prevent leakage from such bags.

SUMMARY OF THE INVENTION

In accordance with the present invention, two four-film diagonal seals each extend from the gusset point of a thermoplastic bag to the edge of the bag where the gusseted side walls are connected to the front and rear bag walls. These four-film seals extend through the front and back side walls and the two gusset walls of the thermoplastic bag. The gusset seals result in a garbage bag that has significantly increased load carrying capacity with no accompanying leakage as compared to a standard gusseted bag and as compared to a bag with two film diagonal seals.

Further in accordance with the invention, the angle seals extend at an angle of less than 45° with respect to the bottom seal. In accordance with the invention, a diagonal seal with an angle of between and 25° and 35° with respect to the bottom seal has this superior load-carrying capacity.

The foregoing and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1:
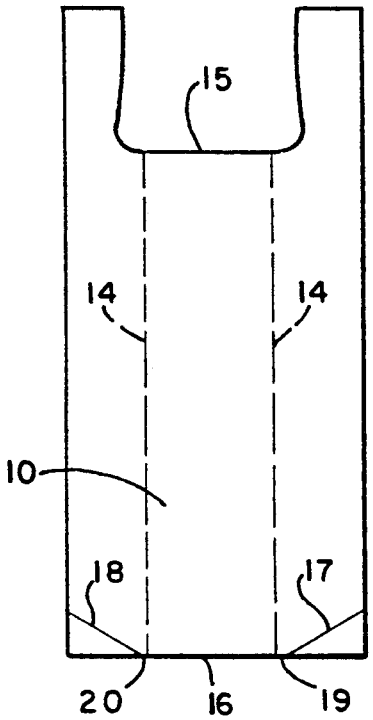
FIG. 1 is a front view of the bag of the present invention.

A thermoplastic bag has a front wall 10 and a rear wall 11. Gusseted side walls 12 and 13 connect the front and rear walls. The gusseted side walls 12 and 13 are joined at a gusset fold 14 which is inside the bag. The bag has an open mouth portion 15 and a bottom seal 16 extending along the bottom of the bag.

In accordance with the invention, two four-film diagonal seals 17 and 18 extend from the gusset points 19 and 20 to the edge of the bag where the gusseted side walls are connected to the front and rear bag walls.

Figure 2:
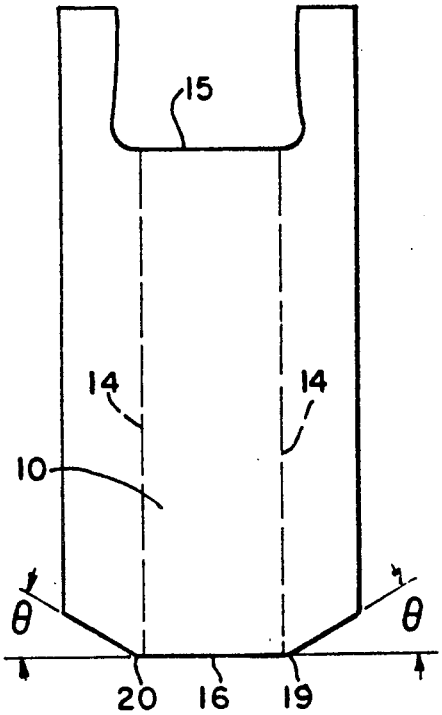
FIG. 2 is a front view of the bag with the corners cut off.
Figure 3:
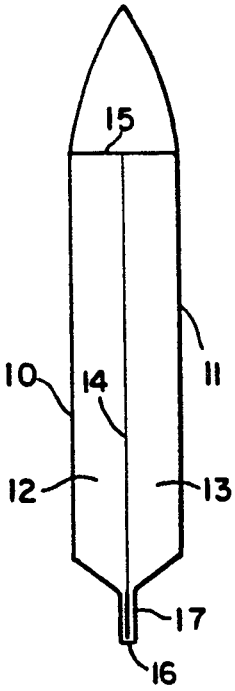
FIG. 3 is a side view of the bag.

The corners below the four-film seals can remain intact as shown in FIG. 1, or they can be cut off as shown in FIG. 2. The four-film seals of the present invention minimize or eliminate stress concentration at the gusset point. This stress is best minimized when the angle of the diagonal seals with respect to the bottom seal is less than 45°. Test results show that the best elimination of leakage is in bags in which the angle $\theta$ is between 25° and 35°.

Figure 4:
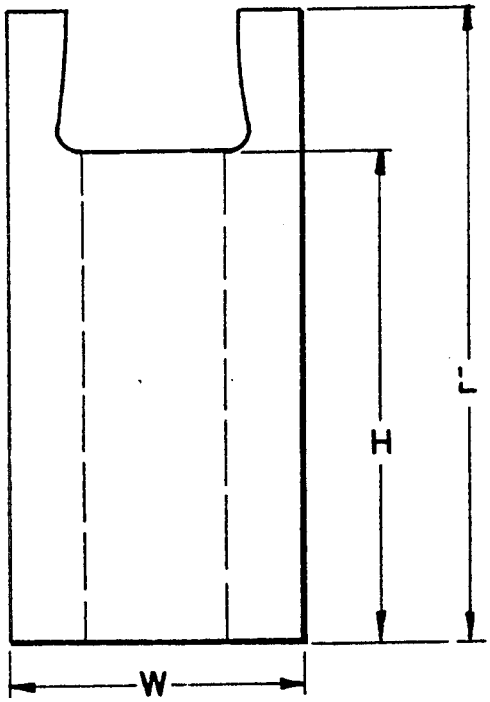
FIG. 4 is a view depicting the dimensions of the bags which were tested.

FIG. 4 depicts the dimensions of the bags which were tested. Two types of bags were tested. The Mobil tall kitchen garbage bag (TKGB) had a height H of 28", a length L of 35", a width W of 16", a handle width of 3" including two plies and a gusset width of 4" which had two plies. The Mobil trash can liners (TCL) which were tested had a height H of 33¼", a length L of 43", a width W of 18½", a handle width of 3⅝" with two plies and a gusset width of 5¾" with two plies.

The test procedure used to determine the efficacy of the heat seals was to suspend the bag by its handles and proceed to fill the bag with water at room temperature. The instant a leak was detected, the water flow into the bag was terminated. The number of gallons required to cause the leak was recorded and converted to pounds. The bags were tested with and without the gusset seals for comparison. The results of the experiments are shown in Table 1 below.

TABLE 1

| PRODUCT TYPE | LOAD | $\sigma$ (LBS) |
|---|---|---|
| Mobil TKGB w/o gusset seals | 25.4 | 3.8 |
| Mobil TKGB w/ gusset seals | 49 | 5.3 |
| Mobil TCL w/o gusset seals | 14.2 | 5.5 |
| Mobil TCL w/ gusset seals | 64.5 | 13.6 |

Table 1 above shows the average load to failure in pounds together with the standard deviation $\sigma$ in pounds.

The gusset seals increased the load-carrying capacity with no leakage, by 4.25 times in the TCL bags and 1.9 times in the TKGB bags.

Similar tests were performed with angle seals extending only through two layers of film as in the Benoit patent referred to above. The test results showed an increase in the load carried by the four-film seals of 0.6 gal. of water over the bags with diagonal two-film seals.

The bags were also tested with different angles $\theta$ for the bottom seal. The test results are given below.

| | HEFTY TKGB HANDLE-TIE PRODUCT | | | | | |
|---|---|---|---|---|---|---|
| | 15° | 25° | 30° | 35° | 40° | 45° |
| Load Test ($H_2O$) | | | | | | |
| | 4.2 | 3.3 | 4.9 | 8.1 | 4.8 | 4.5 |
| | 3.6 | 8.1 | 6.3 | 7.4 | 5.2 | 2.9 |
| | 4.3 | 3.5 | 4.5 | 6.0 | 4.6 | 5.1 |
| | 4.5 | 9.0 | 4.3 | 6.0 | 4.2 | 4.9 |
| | 4.6 | 3.5 | 5.8 | 6.2 | 5.2 | 6.3 |
| | 4.4 | 4.0 | 5.0 | 9.5 | 4.3 | 4.1 |
| | 3.8 | 9.1 | 5.3 | 5.3 | 5.4 | 4.9 |
| | 4.7 | 6.8 | 5.2 | 7.7 | 5.1 | 5.7 |
| | 4.0 | | 5.1 | 5.3 | 4.9 | 5.3 |
| | 4.1 | | 7.3 | 8.3 | 5.6 | 5.5 |
| X (gal.) | 4.2 | 5.9 | 5.4 | 7.0 | 4.9 | 4.9 |
| X (lbs.) | 35.2 | 49.3 | 44.8 | 58.4 | 41.1 | 41.1 |
| $\sigma$ (lbs.) | | 2.9 | 21.7 | 7.4 | 11.9 | 3.87.9 |
| Drop Test (25 lbs.) | | | | | | |

-continued

| | HEFTY TKGB HANDLE-TIE PRODUCT | | | | | |
|---|---|---|---|---|---|---|
| | 15° | 25° | 30° | 35° | 40° | 45° |
| X (ft) | — | — | 11.2 | 10.6 | — | — |

These results show the superiority of diagonal seals having an angle $\theta$ less than 45° and in the range of 25° to 35°.

While a particular embodiment has been shown and described, various modifications of the invention are possible. The appended claims are, therefore, intended to cover all such modifications.

What is claimed is:

1. A thermoplastic bag comprising:

front and rear bag walls;

gusseted side walls connecting said front and rear walls, said gusseted side walls being joined at a gusset fold which is inside said bag;

an open mouthed top portion;

a bottom seal along the bottom of said bag;

two four-film diagonal seals each extending from approximately the gusset points where said gusset folds intersect said bottom seal to the edge of said bag where gusseted side walls are connected to said front and rear bag walls, said diagonal seals extending at an angle between 25° and 35° with respect to said bottom seal.

* * * * *